US009482498B1

(12) United States Patent
Miller et al.

(10) Patent No.: US 9,482,498 B1
(45) Date of Patent: Nov. 1, 2016

(54) RESETTING GUN TARGET

(71) Applicant: Ex Nihilo, LLC, Lehi, UT (US)

(72) Inventors: Jared Miller, Lehi, UT (US); Peter Bunnell, Provo, UT (US)

( * ) Notice: Subject to any disclaimer, the term of this patent is extended or adjusted under 35 U.S.C. 154(b) by 7 days.

(21) Appl. No.: 14/487,029

(22) Filed: Sep. 15, 2014

(51) Int. Cl.
*F41J 7/00* (2006.01)
*F41J 7/04* (2006.01)

(52) U.S. Cl.
CPC .... *F41J 7/04* (2013.01); *F41J 7/00* (2013.01)

(58) Field of Classification Search
CPC ..... F41J 7/00; F41J 7/04; F41J 1/10; F41J 7/06
USPC ..... 273/390–392, 406, 407; 297/440.13, 297/270.5, 258.1; 472/95, 99–105
See application file for complete search history.

(56) References Cited

U.S. PATENT DOCUMENTS 524,894 A * 8/1894 Forsberg ..... A63B 69/208 248/160
2,481,724 A * 9/1949 Croteau ..... A63F 9/02 108/1
3,161,417 A * 12/1964 Goldfarb ..... A63G 13/10 280/1.22
4,722,537 A * 2/1988 Chau-Pin ..... A47D 13/102 280/1.13
4,807,888 A * 2/1989 Pidde ..... F41J 7/04 273/392
5,927,816 A * 7/1999 Hsu ..... A47C 4/021 297/270.5
6,736,738 B1 * 5/2004 Taa ..... A63B 63/008 273/402
7,028,428 B1 * 4/2006 Spencer ..... A01M 31/06 43/2
7,168,766 B2 * 1/2007 Pelletier ..... A47C 3/029 297/440.13
7,288,033 B1 * 10/2007 Jordan ..... A63B 63/00 473/439
2011/0074110 A1 * 3/2011 Markley ..... F41J 7/04 273/392
2011/0175293 A1 * 7/2011 Brune ..... F41J 7/04 273/406

* cited by examiner

*Primary Examiner* — Mark Graham
(74) *Attorney, Agent, or Firm* — Atlas Intellectual Property Law; Travis Banta

(57) ABSTRACT

An example resetting gun target includes a first curved rocking member; a second curved rocking member; a connector portion joining the first rocking member and the second rocking member and maintaining a space between the first rocking member and the second rocking member; and a central target panel attached to the connector portion and situated in the space between the first curved rocking member and the second curved rocking member. The resetting gun target may further include paddle portions respectively situated at a first end and a second end of each of the first curved rocking member and the second curved rocking member.

10 Claims, 6 Drawing Sheets

RESETTING GUN TARGET

BACKGROUND

1. Technical Field

The present disclosure relates to resetting gun targets.

2. Description of the Related Art

Target shooting has continued to grow in popularity in recent years. In the United States alone, a recent study revealed that more than 20 million people went target shooting in 2011, with an average of 22 days per shooter. The amount of money spent by those shooting participants on target shooting-related equipment was estimated to be around 10 Billion dollars.

Targets are used in shooting ranges to add an element of purpose, measurability, and interest to the sport. Paper and breakable targets provide limited utility as once they are utilized, they have to be replaced, which would require shooters to have to go down range and reset/replace the targets. This is potentially harmful as well as inconvenient to recreational shooters. Thus, for these and other important safety reasons, shooting ranges are engineered to prohibit shooters from entering the range and retrieving or replacing the targets. Rather, expensive automated target retrieval systems are often provided to allow shooters to replace targets, which increase the cost of the sport significantly.

Resetting targets are targets that automatically reset themselves and sustain little to no damage when hit by projectiles, such as bullets. However, many existing resetting targets have springs, linkages, and/or other components that can break or corrode over time because they are either too expensive or incapable of being made out of materials that can stand up to gunfire, thereby limiting their utility and safety advantage. For instance, some resetting targets use swinging target elements which hang from a cross-support. The attachment points of the swinging target elements tend to be weaker and can break if directly hit by gunfire and/or have corroded. Moreover, these resetting targets require a heavy, bulky support structure that is difficult to transport and requires the use of more bullet proof material in order to stand up to gunfire, thereby increasing their cost.

In addition, many resetting targets are stationary and do not provide the experience of having the shooter reacquire their target. They are also less safe as they do not move with the impact of the bullet, thereby increasing the likelihood of ricochet.

SUMMARY

In one innovative aspect, an example resetting gun target includes a first curved rocking member; a second curved rocking member; a connector portion joining the first rocking member and the second rocking member and maintaining a space between the first rocking member and the second rocking member; and a central target panel attached to the connector portion and situated in the space between the first curved rocking member and the second curved rocking member. The resetting gun target may further include paddle portions respectively situated at a first end and a second end of each of the first curved rocking member and the second curved rocking member. Numerous other innovative aspects are also described.

These and/or other aspects provide several advantages over existing solutions including, but not limited to that the targets have no moving parts to be damaged/serviced, the entire target can moves with the bullet allowing dispersion of force creating a safer experience, the entire target can be constructed out of materials that will stand up to any caliber of ammunition, the shooter can position the target by simply by shooting at it, the target moves from one position to another, thereby providing the shooter with the experience of having to reacquire the target, etc.

It should be understood that the language used in the present disclosure has been principally selected for readability and instructional purposes, and not to limit the scope of the subject matter disclosed herein.

BRIEF DESCRIPTION OF THE DRAWINGS

The present disclosure is illustrated by way of example and not by way of limitation in the figures of the accompanying drawings in which like reference numerals are used to refer to similar elements.

DETAILED DESCRIPTION

The present disclosure describes an innovative resetting target that a person can take to a shooting range, place on the ground, and then shoot at with a firearm (or other device configured to launch projectiles) from a safe distance. Due to its innovative design, the target rocks back and forth on rockers when its target portion is hit by projectiles fired by the shooter. This target can also be turned and/or spun to a degree on the rockers from side to the side, exposing the target paddles at the ends of the rockers. The multiplicity of these target paddles allows for a target to always be present to the shooter regardless of how the target is moved, spun, rocked, etc., during shooting.

Figure 1:
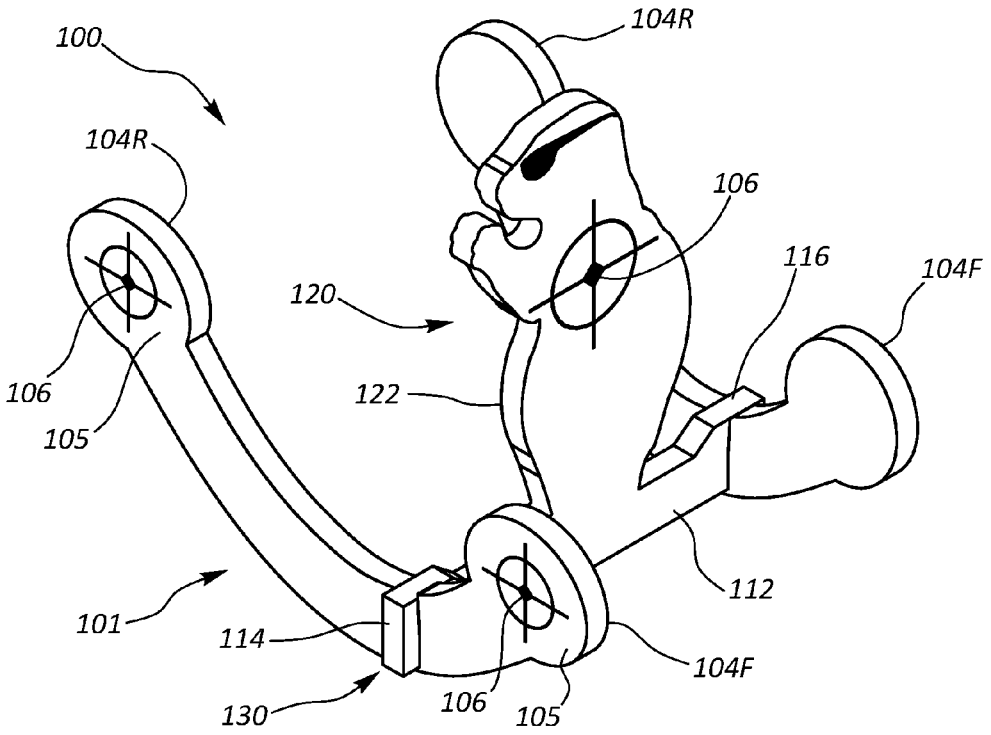
FIG. 1 is a left-top perspective view of an example resetting gun target.
Figure 2:
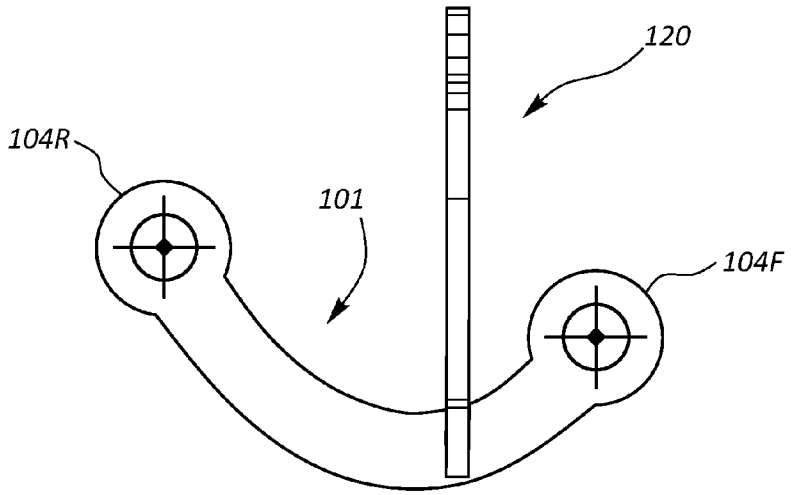
FIG. 2 is a left side view of the example resetting gun target of FIG. 1.
Figure 3:
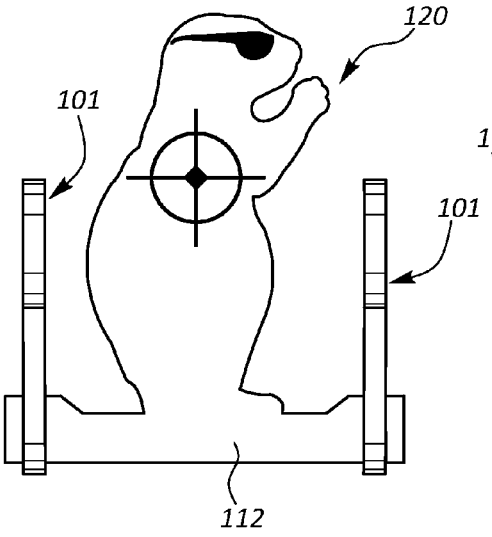
FIG. 3 is a rear view of the example resetting gun target of FIG. 1.
Figure 4:
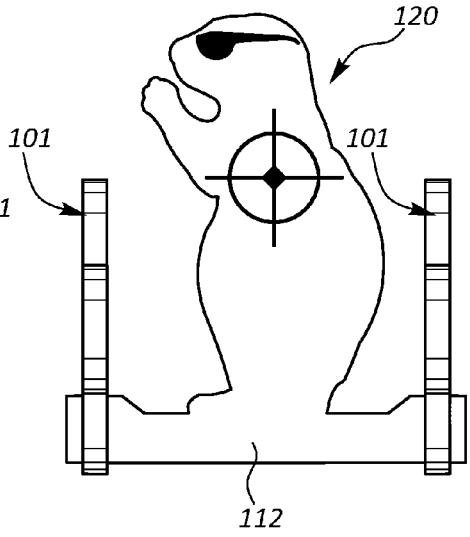
FIG. 4 is a front view of the example resetting gun target of FIG. 1.
Figure 5:
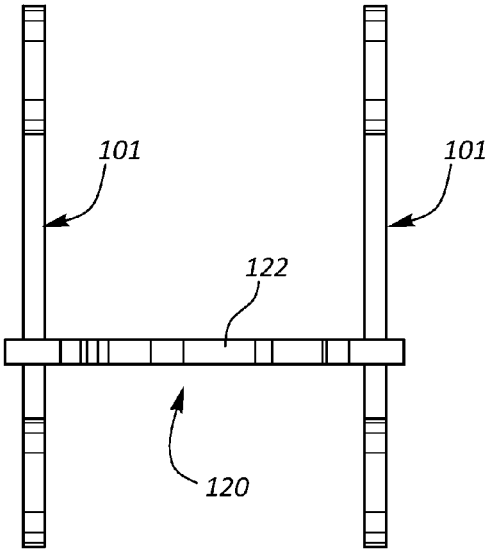
FIG. 5 is a plan view of the example resetting gun target of FIG. 1.
Figure 6:
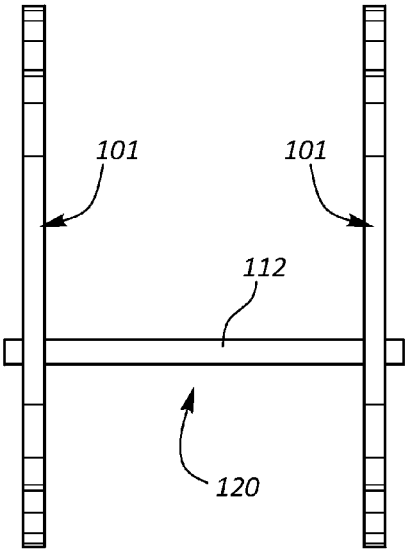
FIG. 6 is a bottom view of the example resetting gun target of FIG. 1.

FIGS. 1-6 are views of an example resetting gun target 100. In particular, FIG. 1 is a left-top perspective view, FIG. 2 is a left side view, FIG. 3 is a rear view, FIG. 4 is a front view, FIG. 5 is a plan view, and FIG. 6 is a bottom view of the resetting gun target 100. FIGS. 1-6 are described in the collective in the following paragraphs, and some reference characters may exist in one but not all views so as not to obscure the illustrated embodiment.

In the depicted embodiment, the resetting gun target 100 includes a first curved rocking member 101, a second curved rocking member 101, and a target portion 120 including a connector portion 112, and a central target panel 122. For simplicity, the curved rocking members 101 are also sometimes referred to herein as rockers 101. While two rockers 101 are depicted in FIGS. 1-6, it should be understood that more than two rockers 101 or one suitably wide rocker may be included without departing from the scope of the present disclosure.

As shown, the connector portion 112 joins the first rocking member 101 and the second rocking member 101 together. It also securely maintains a space between the first rocking member 101 and the second rocking member 101. The central target panel 122 is attached to the connector portion 112, and provides the shooter with a central target at which to aim. The connector portion 112 allows for the central target panel 122 to be any shape desired, not constraining the panel 122 to be the necessary shape to reach/attach to both rockers, although other variations are possible where the connector portion 112 is incorporated into the panel 122 based on the design of the panel 122.

Figure 8:
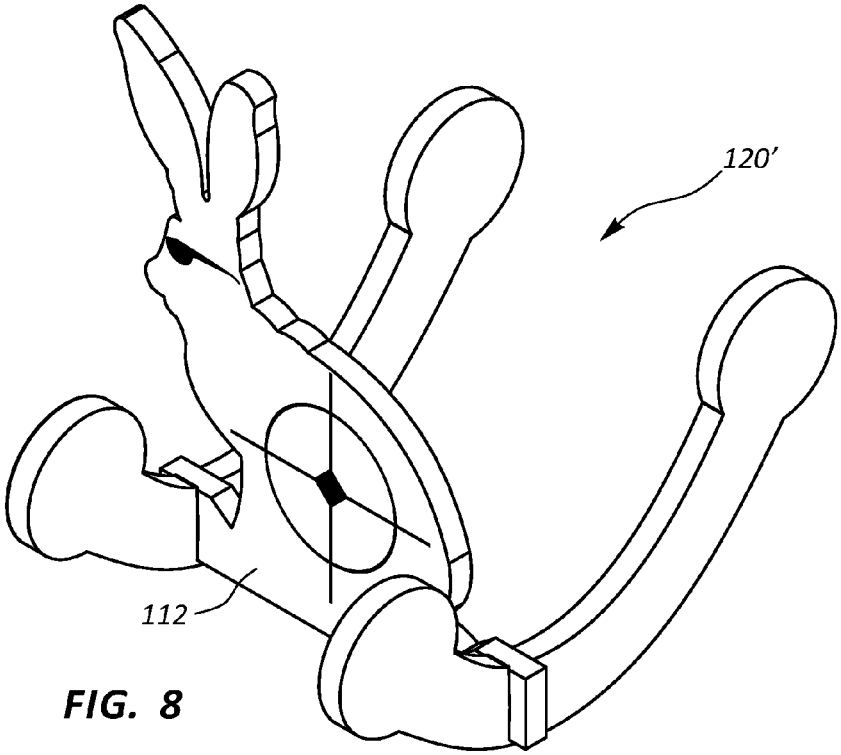
FIGS. 8 and 9 are perspective views of example resetting gun targets having various example target portions.
Figure 9:
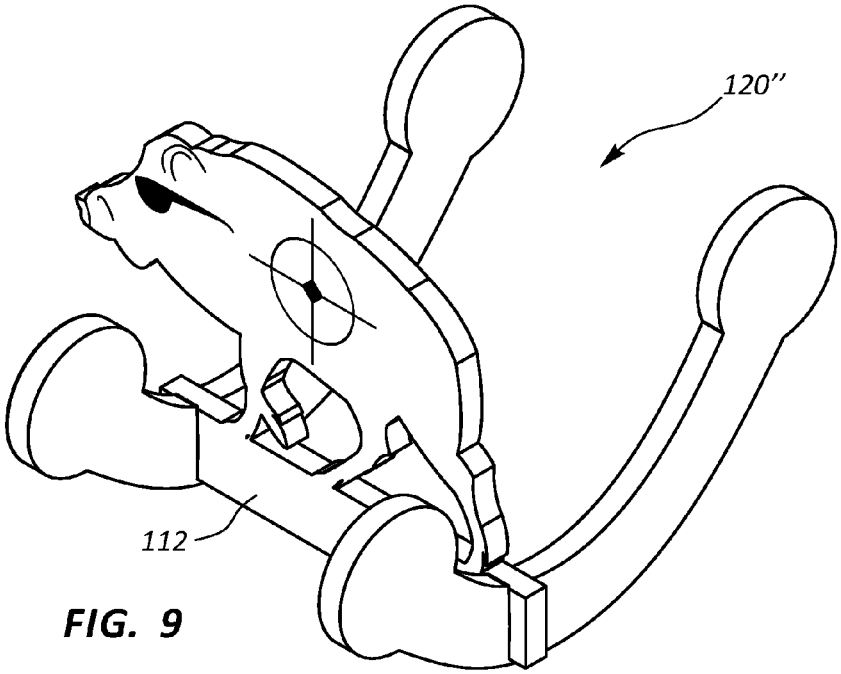

In the depicted example, the central target panel 122 is animal-shaped to resemble game that the shooter might encounter during a hunt, thereby allowing the shooter to refine his/her marksmanship for a particular type of game. However, it should be understood that the central target panel 122 can take any form and/or have any shape provided its size and shape are compatible with the length and curvature of the rockers 101 and the width of the connector portion 112. Additional non-limiting examples of shapes that the central target panel 122 can have are depicted in FIGS. 8 and 9. In particular, FIG. 8 is a perspective view of a rabbit-shaped central target panel 122 attached to the connector portion 112, and FIG. 9 is a perspective view of a hog-shaped central target panel 122 attached to the connector portion 112. In addition, while the central target panel 122 is depicted as being substantially two-dimensional in shape, it should be understood that the central target panel 122 could be three dimensional in shape (e.g., be a three dimensional representation of an animal or other entity and/or could include multiple different surfaces on different planes offering a number of different targeting elements to the shooter, etc.).

Due to the positioning of the first curved rocking member 101, the second curved rocking member 101, and the connector portion 112, the central target panel 122 is situated in the space between the first curved rocking member 101 and the second curved rocking member 101. In some embodiments, the target panel 122 is positioned substantially perpendicular to the shooter and the rockers 101 when the target 100 is viewed from the front. When viewed from the side, the target panel 122 extends vertically upward from the connector portion 112. In some embodiments, when viewed from the side, the target panel 122 may tilt −30 to 30 degrees relative to a true vertical plane. For example, a steady state on a substantially horizontal surface, the target portion 120 will lean back at an angle of about 8 degrees relative to a vertical plane. This is advantageous as it can direct a projectile that directly hits the target portion 120 backwards and away from the shooter, thereby preventing shrapnel from the initial impact ricocheting in the direction of the shooter. In some embodiments, the target panel 122 may not tilt or may only tilt slightly (±1-2 degrees). Numerous other variations are also possible and contemplated.

In the depicted example, the curved rocking members 101 are mirror images of/symmetrical relative to one another. For instance, the curved rocking members 101 are adjacently spaced apart, aligned front to back, and are substantially parallel, although other configurations are possible and contemplated where the curved rocking members 101 may be shaped such that the members 101 converge and/or separate at different points along their length (e.g., measured along the axis of curvature, etc.), and/or the rocking members 101 are non-symmetrical but still compatible and suitable for rocking back and forth and eventually resetting the target/dampening the movement caused by the force of projectiles.

In an example, the components (rockers 101 and target portion 120) of the resetting gun target 100 may be made out of steel having a thickness sufficient (e.g., 0.5 inches, 0.375 inches, 0.25 inches, etc.) to rebuff direct hits by various different caliber ammunition (e.g., 0.20 inches to 0.5 inches/5 mm to 12.7 mm). However, it should be understood that in this or other embodiments, other ballistic, plating material, or any other solid material that can withstand gunfire may be used, such as iron, titanium, Kevlar, dyneema, twaron, spectra, ceramic, etc.

Figure 7:
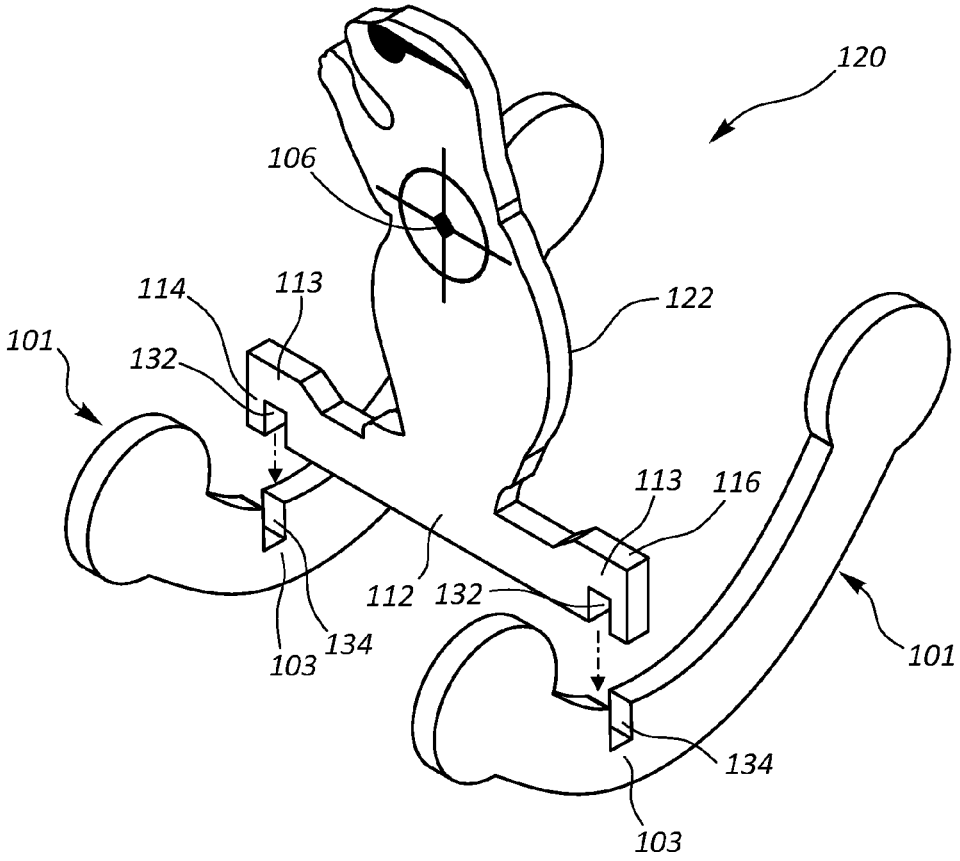
FIG. 7 is an exploded view of the example resetting gun target of FIG. 1.

As depicted, the curved rocking members 101 are connected to the ends of the connector portion 112. In some embodiments, the curb rocking members 101 and the connector portion may be initially distinct elements that are coupled together in a manner robust enough to withstand repeated gunfire. For example, FIG. 7 is an exploded view of the example resetting gun target of FIG. 1. This view depicts an example of how the target portion 120 and the curved rocking members 101 may be joined.

In particular, as shown, the connector portion 112 includes a first end 114 and a second end 116, each of which includes a first joining portion 132. In a similar fashion, the first curved rocking member 101 and the second curved rocking member 101 each include a second joining portion 134 mateable to the corresponding first joining portion 132 to form a joint. In the depicted example, the first joining portion 132 and the second joining portion 134 are U-shaped, although it should be understood that other types of joints and/or shapes may be used to join the rockers 101 and the target portion 120, such as a vertical slot extending from bottom to top of the runners 102 on side of the runners 102 facing the target portion, each vertical slot configured to receive a corresponding end (114 or 116) of the connector portion 112, which in this case is rectangularly shaped and configured to snugly fit within the vertical slot. Numerous other variations are also possible and contemplated.

Returning to the example in FIG. 7, the first joining portion 132 receives a bridge portion 103 of the runner 102 of the rocker 101 and the second joining portion 134 receives a bridge portion 113 of the connector portion 112. Once inserted, the bridge portions 103 of the runner 102 abut against the bridge portions 113 of the connector portion 112 with the joining portions 132 and 134, thereby forming joints 130 which join the rockers 101 and the target portion 120 together.

In some embodiments, the joints 130 joining the rockers 101 and target portion 120 may be attached and/or reinforced to prevent the components from separating, breaking, cracking, etc., due by repeated direct hits from gunfire. For example, the joints (e.g., the first joining portion and the second joining portion) may be welded using any suitable welding method. Once attached and/or reinforced, the components of the target 100 are securely and rigidly fastened to one another and can sustain repeated gunfire without breaking or separating.

In some embodiments, the components may be joined using fasteners (e.g., one or more tapped/threaded holes extending perpendicular into a flush end surface of each end of the connector portion 112 and corresponding holes in the runners 102 with compatibly sized bolts extended therethrough and secured into the corresponding tapped holes). This is advantageous as it allows the components to be disassembled (e.g., to swap out animal shapes) while still providing sufficient assembly strength to withstand repeated gunfire.

In some embodiments, the curved rocking members 101 and the connector portion 120 may be integral components. For example, these components may be contiguous, formed using a manufacturing method, such as casting, forging, 3D printing, milling, etc., that forms a monolithic entity that does not require fastening constituent components together.

As depicted, the connector portion 112 and the central target panel 122 are integral parts. However, in some embodiments, it should be understood that these components could be distinct components that are securely joined/coupled together using the attachment/fastening methods discussed herein.

Numerous other variations for securely and removeably or irremovably joining the target 100 components and/or attaching and/or reinforcing the joints are also possible and/or contemplated.

Referring again to FIGS. 1-6, as discussed above, in the example embodiment, the target portion 120 sits on the rockers 101 when at a steady state on a horizontal surface. During use, the central target panel 122 stands substantially perpendicular relative to the floor/ground. When the central target panel 122 receives an impact from a projectile fired at it, the impact forces the central target panel 122 to rock backwards on the rockers 101. Gravity then causes the central target panel 122 to continue rocking backwards and forwards on the rockers 101 until it reaches a steady state. This innovative rocking feature allows the target to reset itself.

In some embodiments, the rockers 101 include targets (e.g., formed by paddles 104F and 104R) at various different positions and/or angles. The positioning of these targets allows for shooters to turn/spin/move the target by shooting them. This is beneficial for a number of reasons including, but not limited to, that 1) the shooter can reset the target to a desired orientation him/herself by shooting at it; 2) the shooter does not have to venture down the firing range to reset the target and risk getting shot; 3) the firing range does not have to suspend shooting and inconvenience other shooters; and 4) the firing range does not have to install expensive target retrieval or resetting mechanisms, thereby increasing the cost of the sport.

As depicted in FIGS. 1-6, at the end of each of the first curved rocking member 101 and the second curved rocking member 101 is either a paddle portion 104A or 104R (also individually referred to simply as a paddle 104). The paddle 104 can be shot by a shooter to move (e.g., rotate, shift, nudge, etc.) the target 100 in a desired direction. In the depicted example, the target portion 120 is orientated along a plane extending substantially perpendicular to the planes in which the paddles 104 are situated. This provides that no matter how the target moves, the shooter is always presented with an available target to shoot at, as discussed elsewhere herein. Thus, the paddle portions 104 at the end of the rockers 101 allow for improved movement, stopping, and flexibility while shooting.

Figure 10:
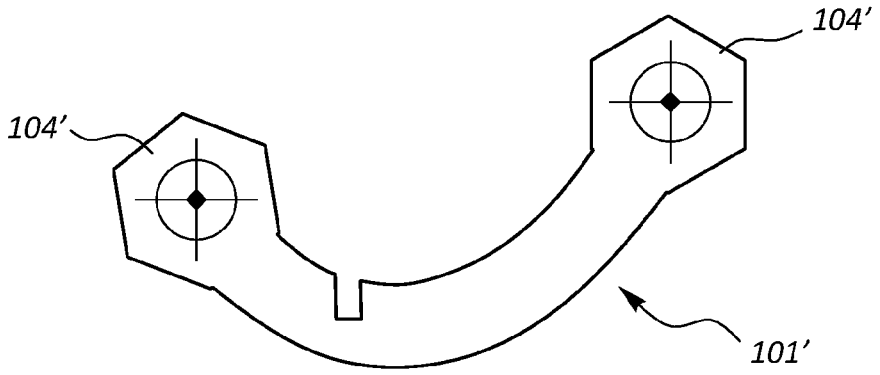
FIGS. 10 and 11 are side views of various example rockers.
Figure 11:
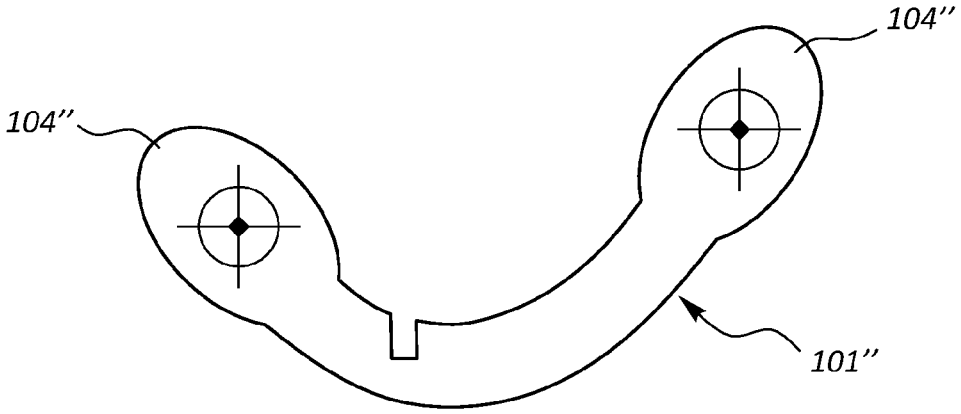

In the depicted embodiment, the paddles 104 are shaped substantially the same, however, in other embodiments the one or more of the paddle portions 104 may have a different shapes. For instance, one of the paddle portions 104 may have a shape different from another of the paddle portions 104. In addition, while in the depicted embodiment the faces of the paddles 104 are round, the paddles 104 can have numerous other shapes and sizes. For instance, FIGS. 10 and 11 are side views of various example rockers 101' and 101" having other shapes. In particular, in FIG. 10, the paddle portions 104' are pentagonally shaped and in FIG. 11, the paddle portions 104" are oval-shaped. In further embodiments, the paddle portions may have any two or three dimensional polygonal shape, rounded, shape, complex geometric shape, etc. In addition, the paddle portions may also be shaped to resemble familiar objects, such as animals or other objects in two or three dimensions.

In some embodiments, the shape(s) of the paddles 104 help limit the extent to which the target 100 rocks when moved by a projectile fired at it. In particular, the paddle portions 104, which in the depicted example are respectively situated at the ends (e.g., first, second) of the first curved rocking member 101 and the second curved rocking member 101, may be configured to limit a rocking motion of the resetting gun target 100 when the central target panel 122 is hit by a projectile to prevent the resetting target 100 from tipping over. For example, if a bullet directly hits the central target panel 120, the force of impact of the bullet on the central target panel 120 initially rocks the target backwards along the curved rocking members 101. If the force of impact is strong enough, the target 100 could tip over as the contact point between the curved rocking members 101 and the ground surface reaches the rear end of the curved rocking members 101. The enlarged (e.g., rounded, pentagonal, oblong, etc.) shape of the paddle portions 104 greatly impede the progression of the rocking target 100 by adding a substantial, additional opposing contact force when coming into contact with the ground surface.

The paddle portions 104 include one or more target surfaces 105 situated at angles different from the angle of the target portion 120 so that the user can hit/maneuver the target 100. In the depicted embodiment, the target face 105 faces outward (e.g., opposite to the space between the first rocking member 101 and the second rocking member 101). In addition, a back-side of the target face 107 that faces inward (e.g., toward the space in which the target portion 120 is situated) may also provide a target face for the shooter to shoot at. The surfaces of the paddle portions 104 and/or the central target panel 122 may include various graphics, such as visuals and other targeting elements for the shooter to aim at. For instance, as depicted, the target face 105 and the central target panel 122 include a bulls-eye graphic 106 visible to a shooter, although numerous other variations are also possible and contemplated.

The resetting gun targets described herein may be manufactured using various methods and/or processes. For instance, an example method cuts the rockers 101 and the target portion 120 out of a sheet of material (e.g., plate steel) and joins the rockers and the connector portion 112. The method can attach and/or reinforce the joints in some embodiments, for example by welding or bolting the joints together. In some embodiments, the paddle portions 104 may be formed with the runners 102, or may be attached thereto (e.g., welded, fastened, etc.). In some embodiments, the faces of the paddles 104 may be place in the same plane as the runners 102. The central target panel 122 could function as the connector portion 112 depending on the design of the central target panel 122.

Figure 12:
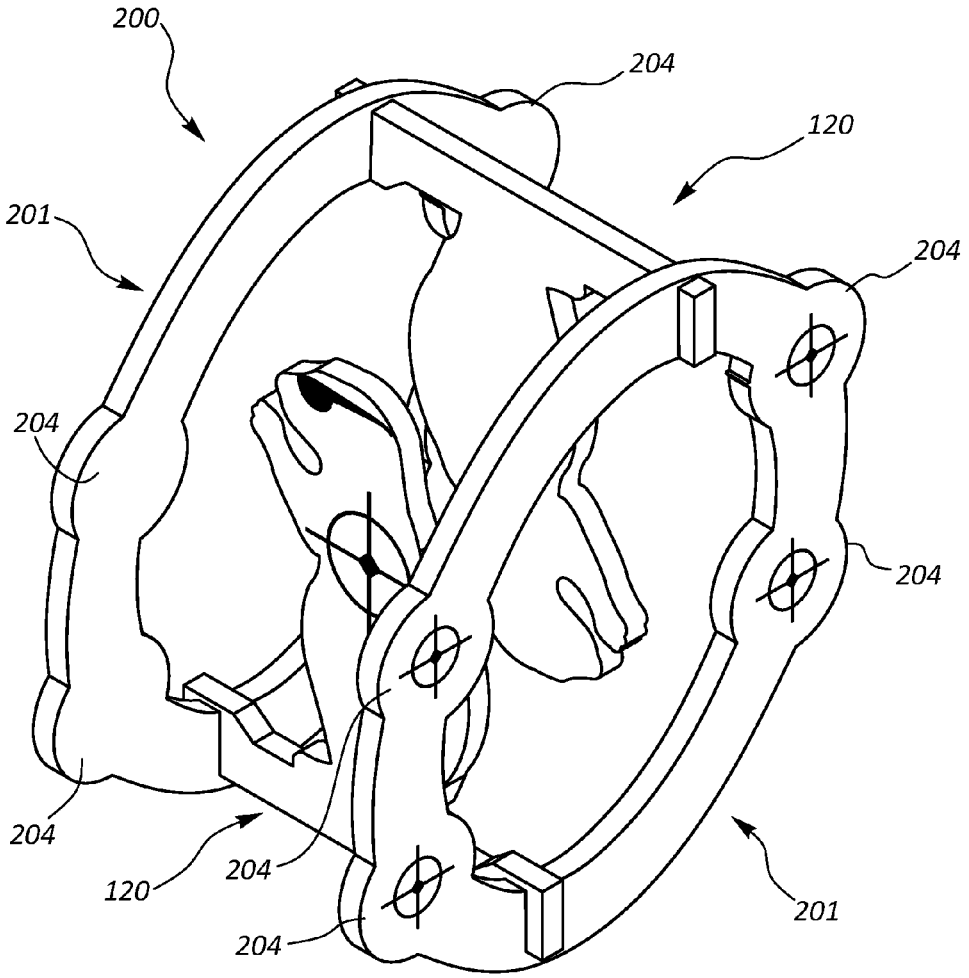
FIG. 12 is a top-right perspective view of another example resetting gun target.

FIG. 12 is a top-right perspective view of another example resetting gun target 200. In this embodiment, the resetting gun target 200 includes at least two rockers 201, and one or more target portions 120 (in this case two). The design depicted in FIG. 12 is advantageous as it eliminates the possibility of tipping at least in the front/back direction by extending the rockers 201 past the initial front and rear paddle portions 204 around 360 degrees to form ring-shaped rockers 201. In addition, as depicted, as the target 200 rolls along, the front target portion 120 rotates towards the back and the back target portion 120 rotates toward the front thereby providing the shooter with a target portion should the target 200 rotate substantially, for example 180 degrees. The paddle portions 204 may have the same or substantially similar shape to the paddle portions 104 discussed above, so the description of these components will not be repeated here. In addition, the target portions 120 and the joining and manufacturing of the rockers 201 and the target portions 120 are substantially similar or the same as that discussed above with respect to the target 100, and thus the description of those features will not be repeated here.

In the foregoing description, for purposes of explanation, numerous specific details are set forth in order to provide a thorough understanding of the technology. It will be apparent, however, that the technology described herein can be practiced without these specific details.

Reference in the specification to "one embodiment", "an embodiment", "some embodiments", or "other embodiments" means that a particular feature, structure, or characteristic described in connection with the embodiment is included in at least one embodiment of the disclosure. The appearances of the term "embodiment" or "embodiments" in various places in the specification are not necessarily all referring to the same embodiment.

In addition, it should be understood and appreciated that variations, combinations, and equivalents of the specific embodiments, implementations, and examples may exist, are contemplated, and are encompassed hereby. The invention should therefore not be limited by the above described embodiments, implementations, and examples, but by all embodiments, implementations, and examples, and other equivalents within the scope and spirit of the invention as claimed.

What is claimed is:

1. A resetting gun target, comprising:

a first curved rocking member;

a second curved rocking member;

a connector portion joining the first rocking member and the second rocking member and maintaining a space between the first rocking member and the second rocking member;

a central target panel attached to the connector portion and situated in the space between the first curved rocking member and the second curved rocking member; and paddle portions respectively situated at a first end and a second end of each of the first curved rocking member and the second curved rocking member, wherein the paddle portions each include a target face that faces opposite to the space between the first rocking member and the second rocking member and further wherein the target face and the central target panel include a bulls-eye graphic visible to a shooter.

2. The resetting gun target of claim 1, wherein the paddle portions are shaped substantially the same.

3. The resetting gun target of 1, wherein one of the paddle portions has a different shape from another of the paddle portions.

4. The resetting gun target of claim 1, wherein the paddle portions are configured to limit a rocking motion of the resetting gun target when the central target panel is hit by a projectile to prevent the resetting gun target from tipping over.

5. The resetting gun target of claim 1, wherein the first curved rocking member and the second curved rocking member are symmetrical relative to one another.

6. The resetting gun target of claim 1, wherein the connector portion includes a first end and a second end, and the first end and the second end each include a first joining portion, the first curved rocking member and the second curved rocking member each include a second joining portion mated to the corresponding first joining portion forming a joint.

7. The resetting gun target of claim 1, wherein the first joining portion and the second joining portion are U-shaped.

8. The resetting gun target of claim 1, wherein the first joining portion and the second joining portion are welded together.

9. The resetting gun target of claim 1, wherein the central target panel is animal-shaped.

10. The resetting gun target of claim 1, wherein the first curved rocking member, the second curved rocking member, and the central target panel are made of steel.

* * * * *